US012765669B2

(12) United States Patent
Chen et al.

(10) Patent No.: US 12,765,669 B2
(45) Date of Patent: Oct. 20, 2026

(54) RACK MOUNTING KIT

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Kai-Wen Yu, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 4 days.

(21) Appl. No.: 18/902,890

(22) Filed: Sep. 30, 2024

(65) Prior Publication Data

US 2025/0344853 A1 Nov. 13, 2025

(30) Foreign Application Priority Data

May 9, 2024 (TW) ..... 113117376

(51) Int. Cl.
*A47B 88/407* (2017.01)

(52) U.S. Cl.
CPC ..... *A47B 88/407* (2017.01)

(58) Field of Classification Search
CPC ..... A47B 88/407
See application file for complete search history.

(56) References Cited

U.S. PATENT DOCUMENTS 6,666,340 B2 * 12/2003 Basinger ..... A47B 88/43 211/175
6,769,551 B2 * 8/2004 Rafferty ..... H05K 7/1492 211/192
6,773,080 B2 * 8/2004 Chen ..... A47B 88/43 248/220.22
7,641,297 B2 * 1/2010 Huang ..... H05K 7/1489 312/334.4
7,950,538 B2 * 5/2011 Zang ..... A47B 57/20 211/187
7,975,860 B2 * 7/2011 Dittus ..... H05K 7/1489 211/207
8,231,188 B1 * 7/2012 Chen ..... A47B 88/57 312/334.47
8,282,176 B1 * 10/2012 Chen ..... A47B 88/493 312/334.46
8,371,454 B2 * 2/2013 Chen ..... H05K 7/1421 312/334.4

(Continued)

*Primary Examiner* — Eret C Mcnichols
(74) *Attorney, Agent, or Firm* — Winston Hsu

(57) ABSTRACT

A rack mounting kit is provided and includes a frame and a handle. The frame includes a mounting feature. The handle is movably mounted on the frame and includes a positioning feature. When the handle is in a locking state, both of the positioning feature of the handle and the mounting feature of the frame face toward a mounting direction for allowing the rack mounting kit to be mounted on a rack. When the handle moves from the locking state to an unlocking state, the positioning feature of the handle faces toward an operating direction different from the mounting direction for allowing the handle to be held by a user.

12 Claims, 18 Drawing Sheets

(56) References Cited

U.S. PATENT DOCUMENTS

| | | | | |
|---|---|---|---|---|
| 9,122,458 | B2 * | 9/2015 | Yu | G06F 1/185 |
| 9,743,767 | B1 * | 8/2017 | Easton | A47B 88/43 |
| 10,383,248 | B1 * | 8/2019 | Chen | H05K 7/18 |
| 11,647,836 | B2 | 5/2023 | Chen | |
| 12,055,169 | B2 * | 8/2024 | Chen | F16B 12/10 |
| 12,289,857 | B1 * | 4/2025 | Chen | H05K 7/1489 |
| 12,414,256 | B2 * | 9/2025 | An | H05K 7/1489 |
| 2004/0037046 | A1 * | 2/2004 | Dittus | G06F 1/183 361/727 |
| 2004/0108427 | A1 * | 6/2004 | Chen | A47B 88/43 312/334.44 |
| 2005/0155941 | A1 | 7/2005 | Hartman | |
| 2009/0294393 | A1 * | 12/2009 | Chen | A47B 88/423 211/183 |
| 2010/0200523 | A1 | 8/2010 | Henderson | |
| 2012/0248952 | A1 * | 10/2012 | Gong | H05K 7/1494 312/244 |
| 2014/0363108 | A1 * | 12/2014 | Chen | A47B 88/43 384/22 |
| 2016/0150659 | A1 * | 5/2016 | Chen | E05B 65/46 292/126 |
| 2021/0378126 | A1 | 12/2021 | Tian | |
| 2023/0029230 | A1 * | 1/2023 | Chen | F16B 12/10 |

* cited by examiner

RACK MOUNTING KIT

BACKGROUND OF THE INVENTION

1. Field of the Invention

The present invention relates to a mounting mechanism, and more specifically, to a rack mounting kit with enhanced operational convenience.

2. Description of the Prior Art

U.S. Pat. No. 11,647,836 B2 discloses a slide rail kit adapted for a rack. The rack includes at least one mounting structure. The at least one mounting structure includes a first predetermined portion and a second predetermined portion. The slide rail kit includes a rail member and a frame. The frame is arranged on the rail member. The frame includes a first mounting feature and a second mounting feature. The first mounting feature is configured to be mounted on the first predetermined portion. The second mounting feature includes a resilient member and a mounting member arranged on the resilient member. The mounting member is configured to be mounted on the second predetermined portion in response to a resilient force generated by the resilient member.

In U.S. Pat. No. 11,647,836 B2, when a user operates the resilient member with one hand to disengage the mounting member of the second mounting feature and the first mounting feature from the rack, the user has to support the slide rail kit with the other hand for preventing the slide rail kit from falling.

However, in order to meet various requirements, it becomes an important topic to provide a different product.

SUMMARY OF THE INVENTION

It is an objective of the present invention to provide a rack mounting kit with enhanced operational convenience.

According to an aspect of the present invention, a rack mounting kit includes a frame and a handle. The frame includes a mounting feature. The handle is movably mounted on the frame and includes a positioning feature. When the handle is in a locking state, both of the positioning feature of the handle and the mounting feature of the frame face toward a mounting direction. When the handle moves from the locking state to an unlocking state, the positioning feature of the handle faces toward an operating direction different from the mounting direction for allowing the handle to be held by a user.

According to another aspect of the present invention, a rack mounting kit is adapted for a rack, and the rack mounting kit includes a frame and a handle. The frame includes a mounting feature configured to be mounted at a first mounting position relative to the rack. The handle is movably mounted on the frame and includes a positioning feature configured to be mounted at a second mounting position relative to the rack. When the handle is in a locking state relative to the frame, the mounting feature located at the first mounting position and the positioning feature located at the second mounting position cooperatively restrain the frame from being detached from the rack. When the handle is released from the locking state relative to the frame, the positioning feature is configured to depart from the second mounting position for allowing the frame to be detached from the rack.

In summary, in the present invention, the handle in the locking state can restrain detachment of the rack mounting kit relative to the rack, and when the handle moves from the locking state to the unlocking state for allowing the detachment of the rack mounting kit relative to the rack, the handle in the unlocking state can be held by the user for easily applying force. Therefore, the present invention has enhanced operational convenience.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
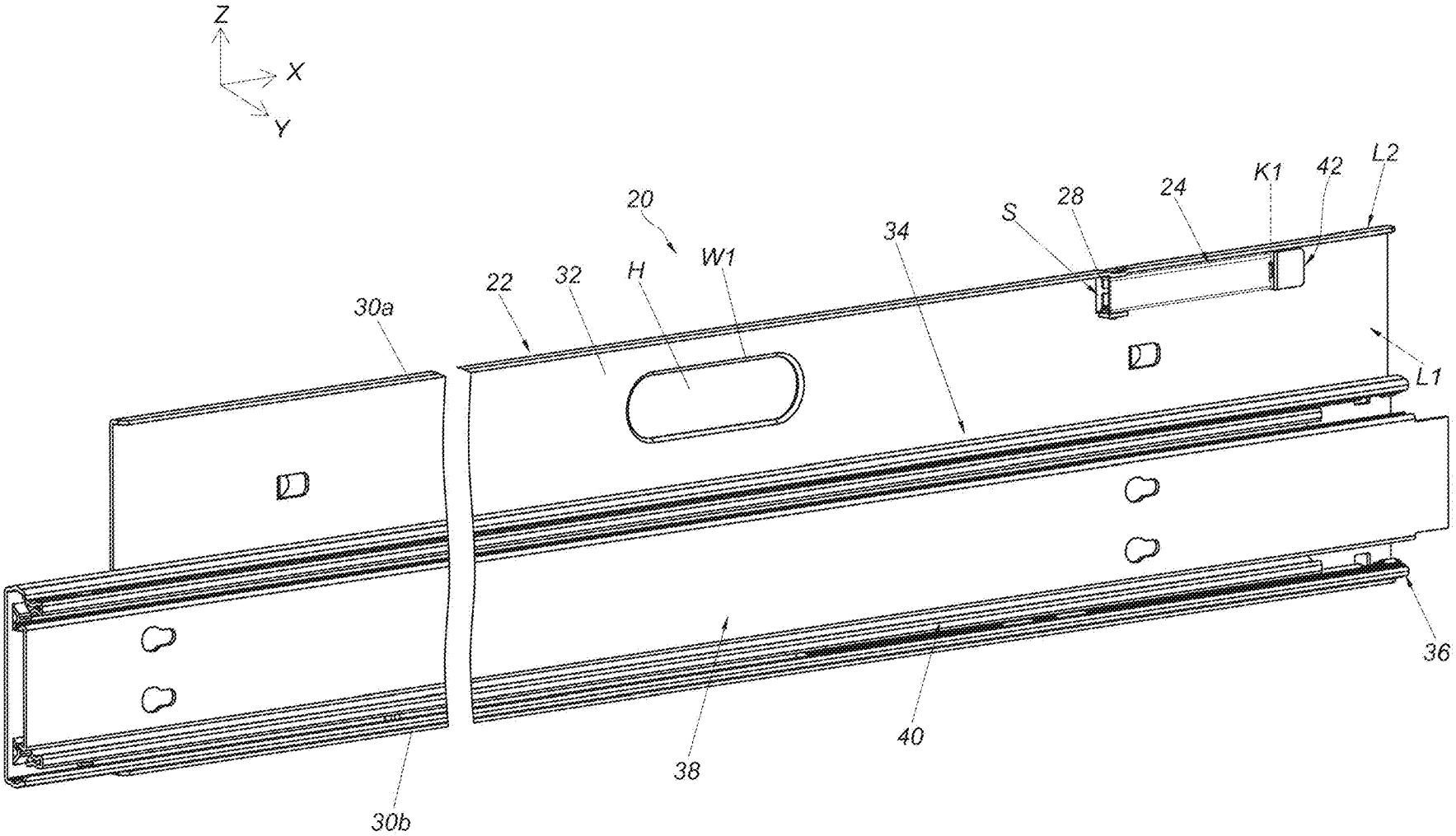
FIG. 1 and FIG. 2 are schematic diagrams of a rack mounting kit as a handle is in a locking state at different views according to a first embodiment of the present invention.
Figure 2:
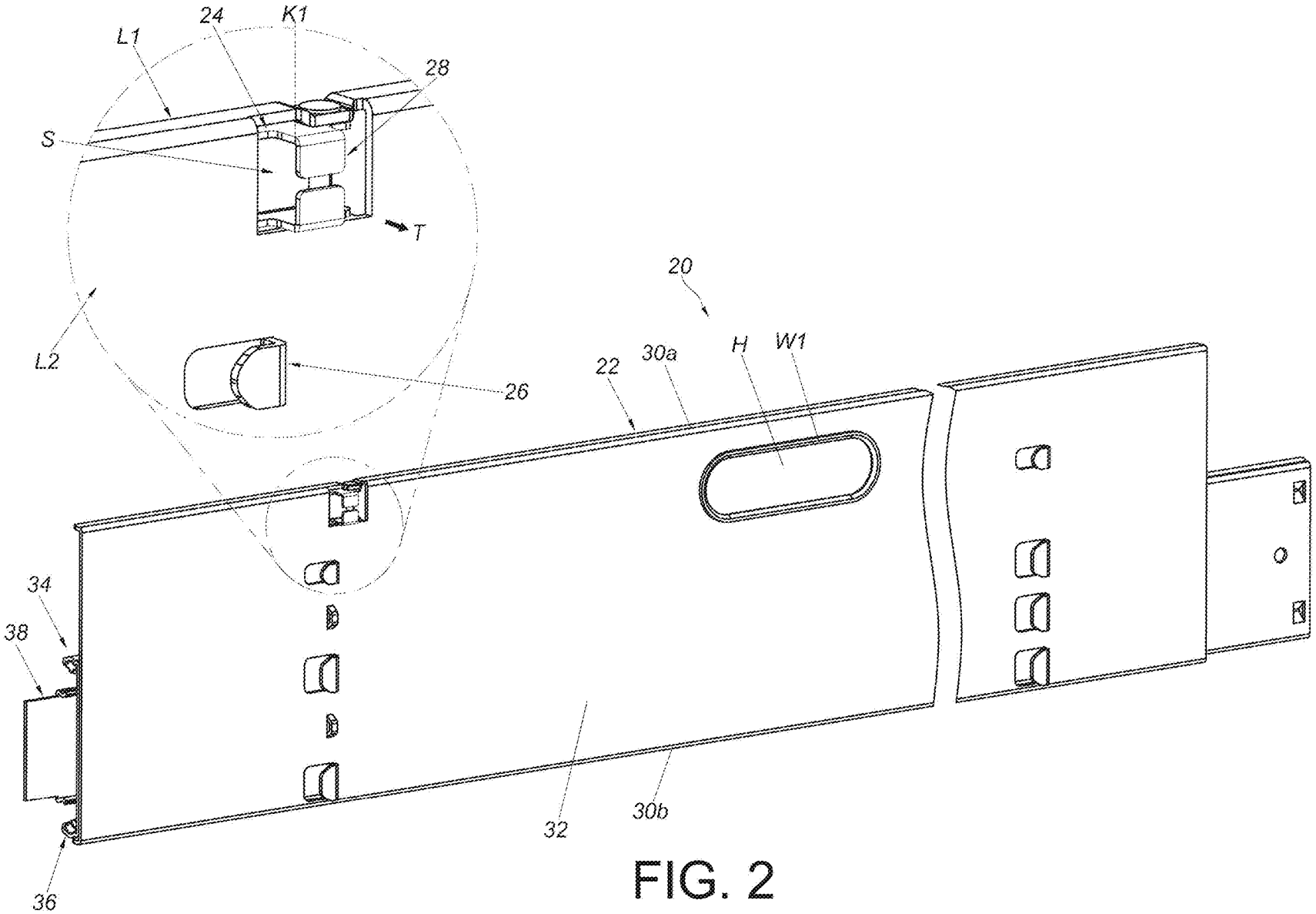
Figure 3:
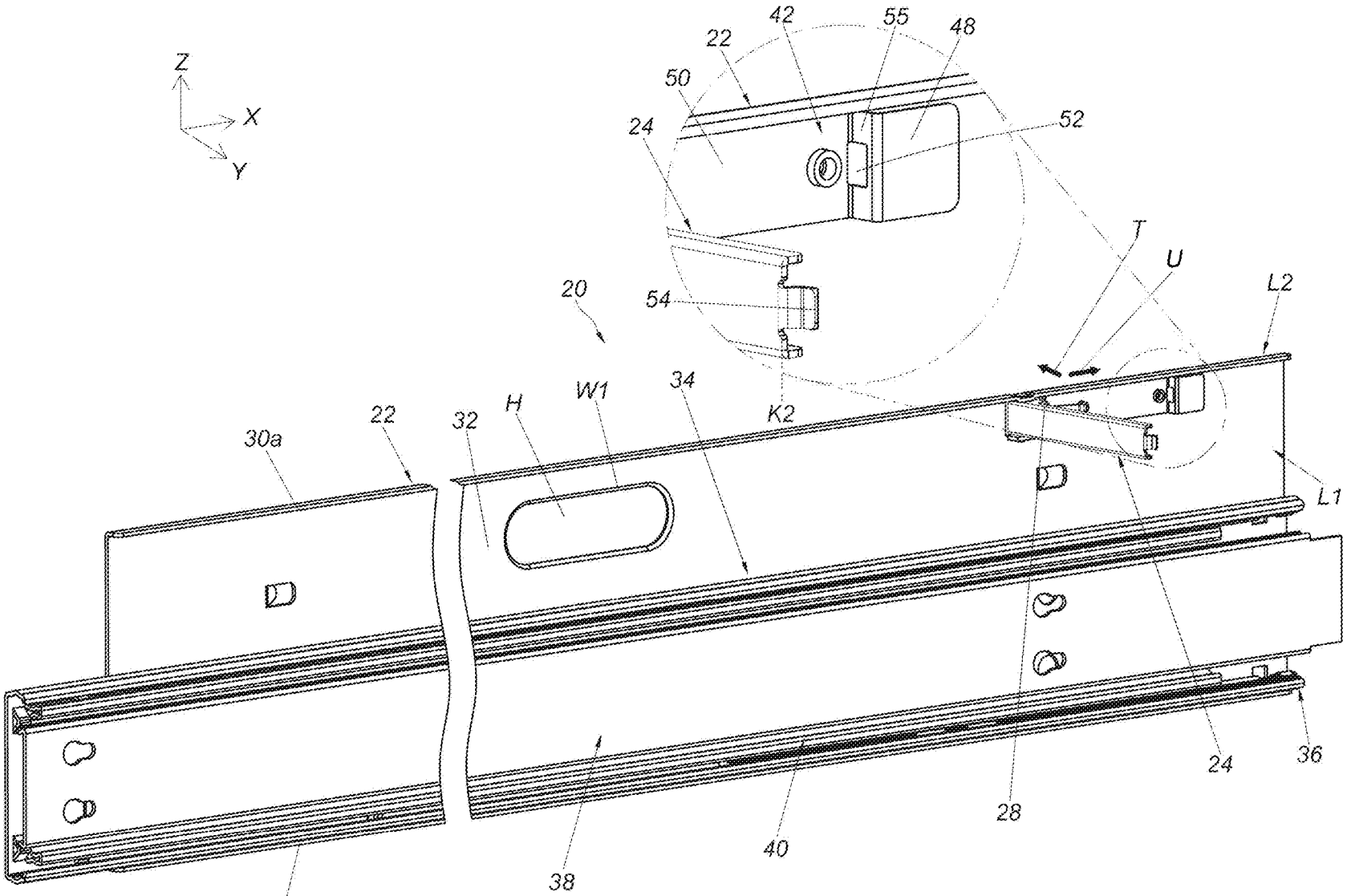
FIG. 3 is a schematic diagram of the rack mounting kit as the handle is in an unlocking state according to the first embodiment of the present invention.

As shown in FIG. 1 to FIG. 3, a rack mounting kit 20 of a first embodiment includes a frame 22 and a handle 24. The frame 22 includes at least one mounting feature 26. The handle 24 is movably mounted on the frame 22 and movable relative to the frame 22 between a locking state K1 as shown in FIG. 1 and FIG. 2 and an unlocking state K2 as shown in FIG. 3. The handle 24 includes a positioning feature 28.

Preferably, the frame 22 includes a first side L1 and a second side L2 opposite to the first side L1 along a transverse direction. In this embodiment, by way of example, the first side L1 and the second side L2 of the frame 22 are an inner side and an outer side of the frame 22, respectively. However, the present invention is not limited to this embodiment.

Preferably, the frame 22 includes a first edge wall 30*a*, a second edge wall 30*b* and a longitudinal wall 32 connected between the first edge wall 30*a* and the second edge wall 30*b* of the frame 22. The first edge wall 30*a* and the second edge wall 30*b* are bent relative to the longitudinal wall 32 and toward the first side L1 of the frame 22. In this embodiment, by way of example, the first edge wall 30*a* and the second edge wall 30*b* are perpendicularly bent relative to the longitudinal wall 32. However, the present invention is not limited to this embodiment.

Preferably, as shown in FIG. 2, the mounting feature 26 of the frame 22 is arranged on the second side L2 of the frame 22 and formed in an L-shaped structure.

Preferably, as shown in FIG. 1 to FIG. 3, a through hole structure H is formed on the longitudinal wall 32 of the frame 22 and defined by a plurality of walls. In this embodiment, by way of example, the through hole structure H is defined by four walls which includes a first wall W1, a second wall, a third wall and a fourth wall, and the first wall W1, the second wall, the third wall and the fourth wall can be an upper wall, a lower wall, a front wall and a rear wall. However, the present invention is not limited to this embodiment. Furthermore, the through hole structure H is communicated between the first side L1 and the second side L2 of the frame 22.

Preferably, the rack mounting kit 20 further includes a rail member mounted on the first side L1 of the frame 22. In this embodiment, by way of example, the rack mounting kit 20 includes a slide rail assembly 34 including a plurality of rail members, e.g., a first rail 36, a second rail 38 and a third rail 40. The third rail 40 is movably mounted between the first rail 36 and the second rail 38. The second rail 38 and the third rail 40 are displaceable relative to the first rail 36 along a longitudinal direction. The first rail 36 is connected, e.g., fixedly connected, to the first side L1 of the frame 22.

In this embodiment, by way of example, the longitudinal direction can be defined by a length direction or a displacement direction of the rail member, e.g., the first rail 36, the second rail 38, or the third rail 40, and parallel to an X axis. A transverse direction can be defined by a lateral direction or a width direction of the rail member, e.g., the first rail 36, the second rail 38, or the third rail 40, and parallel to a Y axis. A vertical direction can be defined by a height direction of the rail member, e.g., the first rail 36, the second rail 38, or the third rail 40, and parallel to a Z axis.

Preferably, the second edge wall 30*b* of the frame 22 is configured to support the slide rail assembly 34. For example, the second edge wall 30*b* of the frame 22 can support a bottom portion of the first rail 36 for enhancing a structural strength or a supporting strength of the slide rail assembly 34.

Preferably, the frame 22 has a first predetermined height, and the slide rail assembly 34 has a second predetermined height less than the first predetermined height. In this embodiment, by way of example, the handle 24 is located adjacent to the first side L1 of the frame 22 and at a position higher than the slide rail assembly 34. However, the present invention is not limited to this embodiment.

Preferably, the rack mounting kit 20 further includes a resilient member 42 arranged on the longitudinal wall 32 of the frame 22 and located at the first side L1 of the frame 22. The resilient member 42 is configured to engage with the handle 24 for retaining the handle 24 in the locking state K1 as shown in FIG. 1 and FIG. 2, or the resilient member 42 is configured to generate a resilient force for driving the handle 24 to disengage from the locking state K1, e.g., move from the locking state K1 to the unlocking state K2 as shown in FIG. 3, when the handle 24 is released from the locking state K1.

As shown in FIG. 2, when the handle 24 is in the locking state K1 relative to the frame 22, both the positioning feature 28 of the handle 24 and the mounting feature 26 of the frame 22 face toward a mounting direction T, e.g., both the positioning feature 28 of the handle 24 and the mounting feature 26 of the frame 22 protrude from the second side L2 of the frame 22 along the mounting direction T.

Preferably, as shown in FIG. 2, a penetrating structure S is formed on the longitudinal wall 32 of the frame 22 and communicated with the first side L1 and the second side L2 of the frame 22. In this embodiment, by way of example, the penetrating structure S is an opening structure. However, the present invention is not limited to this embodiment. When the handle 24 is in the locking state K1 relative to the frame 22, the positioning feature 28 of the handle 24 passes through the penetrating structure S from the first side L1 of the frame 22 to the second side L2 of the frame 22, so as to protrude from the second side L2 of the frame 22 along the mounting direction T.

When the handle 24 moves from the locking state K1 as shown in FIG. 1 and FIG. 2 to the unlocking state K2 as shown in FIG. 3, the positioning feature 28 of the handle 24 does not face toward the mounting direction T, e.g., the positioning feature 28 of the handle 24 faces toward an operating direction U different from the mounting direction T, for allowing the handle 24 to be held by a user. Furthermore, when the positioning feature 28 of the handle 24 faces toward the operating direction U, the positioning feature 28 of the handle 24 does not protrude from the second side L2 of the frame 22 or does not pass through the penetrating structure S. In this embodiment, by way of example, the operating direction U is perpendicular to the mounting direction T, i.e., an extending direction of the handle 24 in the unlocking state K2 is parallel to the transverse direction, for the user to easily hold the handle 24 and apply force onto the handle 24. However, the present invention is not limited to this embodiment. Preferably, when the handle 24 in the unlocking state K2, the user can hold the handle 24 with one hand, e.g., a right hand, and further hold the through hole structure H with the other hand, e.g., a left hand, stretching into the through hole structure H and against the first wall W1, for supporting the rack mounting kit 20 properly.

From the above, the configuration of the handle 24 and the through hole structure H can enable the user to support the rack mounting kit 20 with the two hands properly, and therefore the rack mounting kit 20 can be moved or lifted easily, such that the rack mounting kit 20 has enhanced convenience and/or safety of mounting operation or detachment operation.

Figure 4:
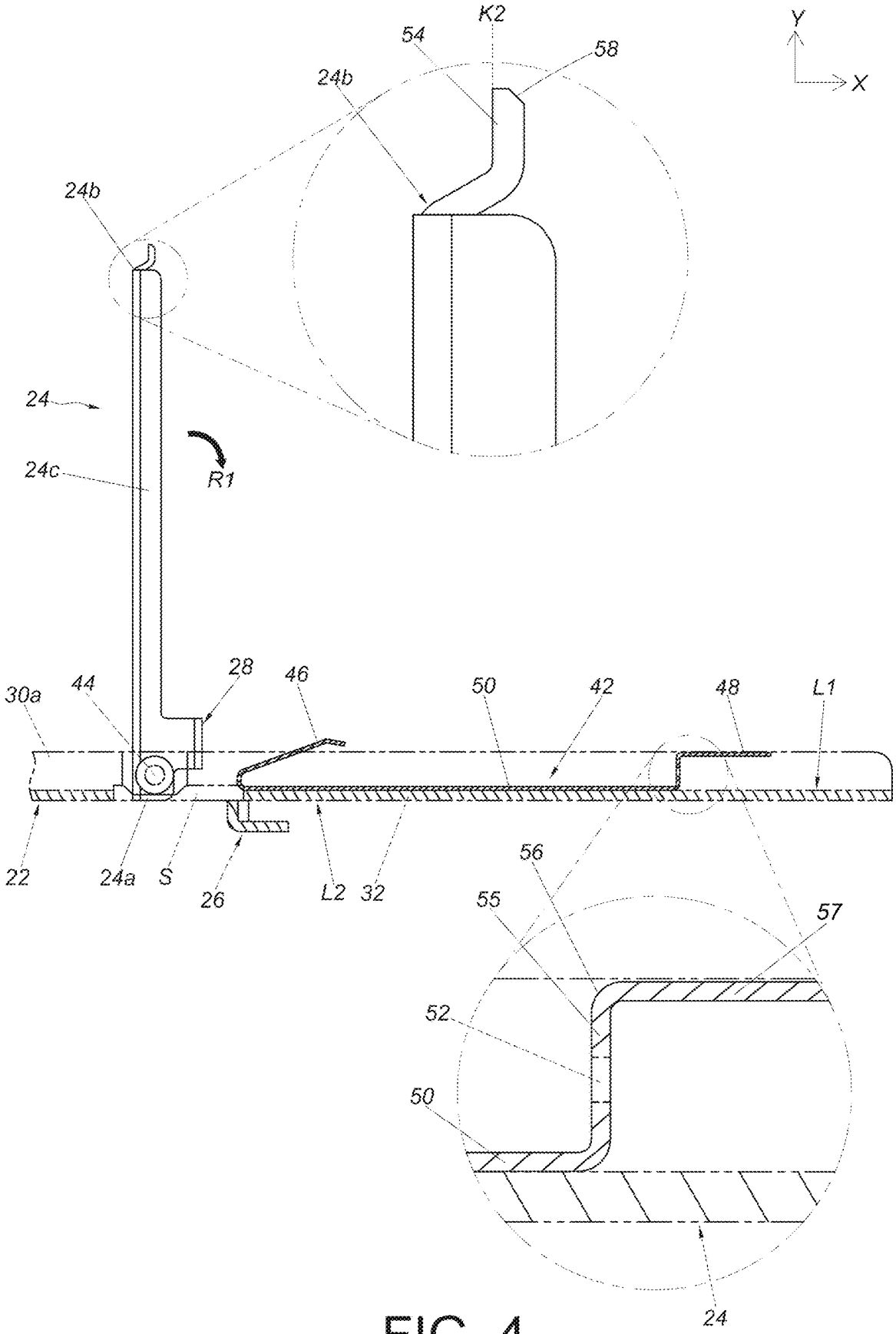
FIG. 4 is a partial diagram of the rack mounting kit as the handle is in the unlocking state according to the first embodiment of the present invention.

As shown in FIG. 4, the handle 24 includes a first end 24*a*, a second end 24*b* and a holding portion 24*c* located between the first end 24*a* and the second end 24*b* of the handle 24. The first end 24*a* of the handle 24 is pivotally mounted on the frame 22. For example, the first end 24*a* of the handle 24 can be pivotally connected to the first edge wall 30*a* of the frame 22 by a shaft 44. The positioning feature 28 is located adjacent to the first end 24*a* of the handle 24.

Preferably, the resilient member 42 includes a resilient arm portion 46, an operating portion 48 and a main body portion 50 extended between the resilient arm portion 46 and the operating portion 48 of the resilient member 42. The main body portion 50 is connected, e.g., fixedly connected, to the first side L1 of the frame 22, and the resilient arm portion 46 and the operating portion 48 are located adjacent to two opposite ends of the main body portion 50. The resilient arm portion 46 is inclined relative to the main body portion 50 by a predetermined angle. The operating portion 48 is bent relative to the main body portion 50.

Preferably, the resilient member 42 and the second end 24*b* of the handle 24 include a first retaining portion 52 and a second retaining portion 54, respectively. In this embodiment, by way of example, the first retaining portion 52 and the second retaining portion 54 are a hole structure and a protrusion, respectively. However, the present invention is not limited to this embodiment.

Preferably, the operating portion 48 is located adjacent to the first retaining portion 52. In this embodiment, by way of example, the operating portion 48 includes an extending section 55 and an operating section 57. The extending section 55 is connected between the main body portion 50 and the operating section 57. The extending section 55 is bent relative to the main body portion 50 along the transverse direction or the lateral direction, and the operating section 57 is bent relative to the extending section 55 along the longitudinal direction. The first retaining portion 52 is formed on the extending section 55.

Figure 5:
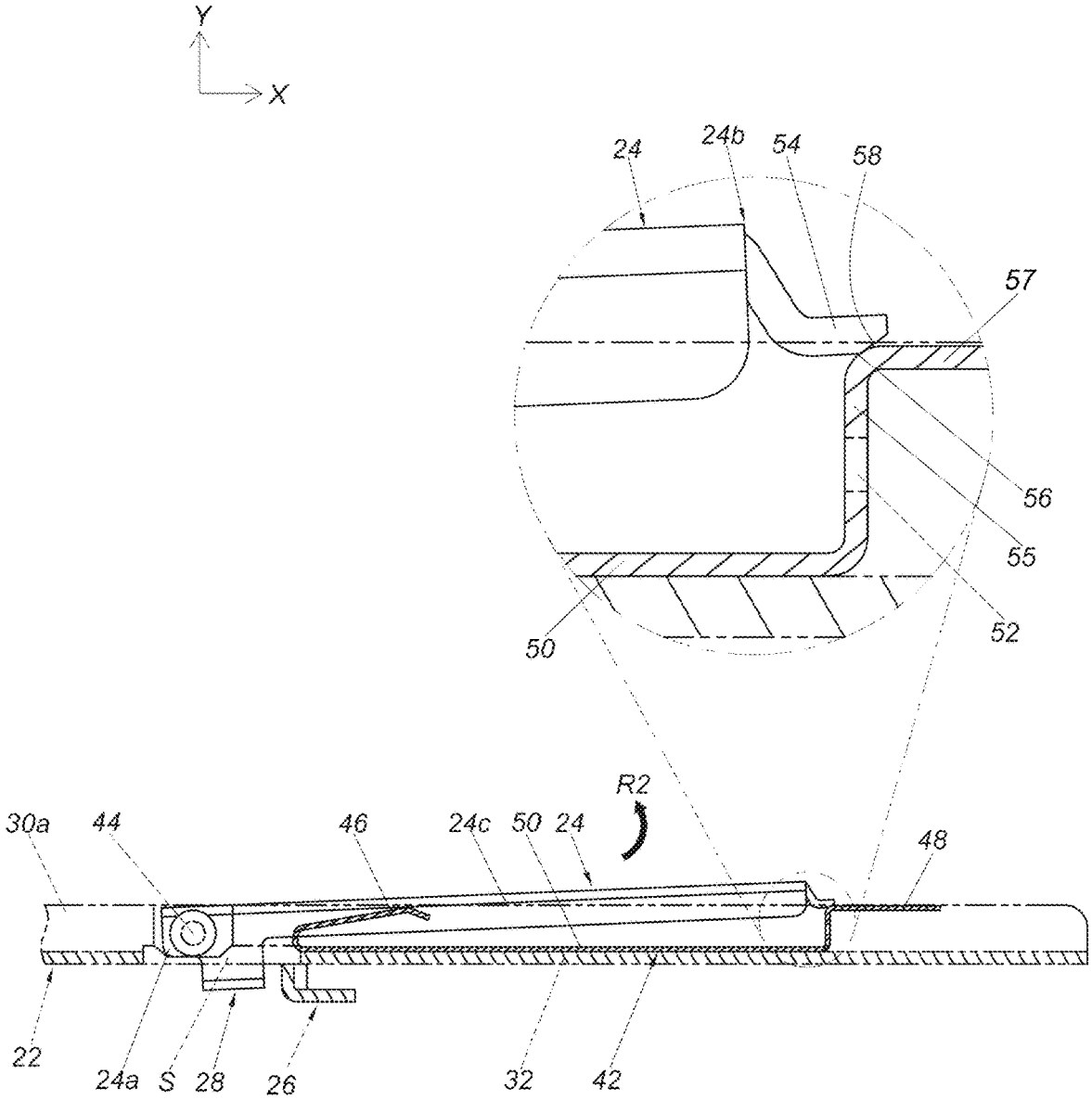
FIG. 5 is a partial diagram of the rack mounting kit as the handle moves toward the locking state from the unlocking state according to the first embodiment of the present invention.
Figure 6:
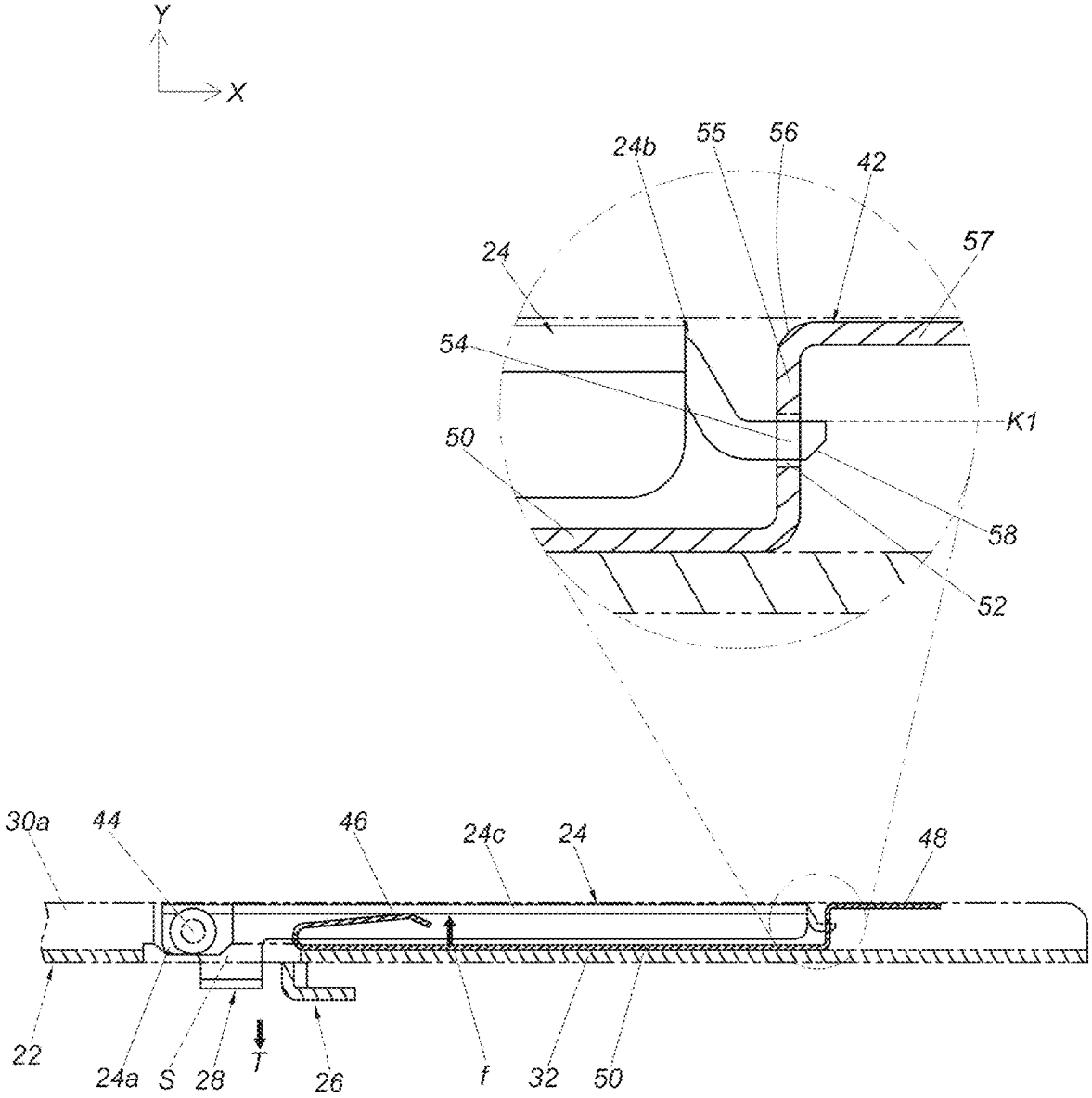
FIG. 6 is a partial diagram of the rack mounting kit as the handle is in the locking state according to the first embodiment of the present invention.

As shown in FIG. 4 to FIG. 6, the handle 24 is movable relative to the frame 22 from the unlocking state K2 as shown in FIG. 4 to the locking state K1 as shown in FIG. 6, or from the locking state K1 as shown in FIG. 6 to the unlocking state K2 as shown in FIG. 4.

Preferably, one of the resilient member 42 and the second end 24*b* of the handle 24 includes a guiding feature, e.g., an inclined surface or an arc surface. In this embodiment, by way of example, the resilient member 42 and the second end 24*b* of the handle 24 include a first guiding feature 56 and a second guiding feature 58, respectively, and the first guiding feature 56 of the resilient member 42 is arranged on a connection of the operating section 57 and the extending section 55.

As shown in FIG. 4 to FIG. 6, when the handle 24 is operated by the user to move relative to the frame 22 from the unlocking state K2 to the locking state K1, e.g., pivot along a first predetermined direction R1, the first guiding feature 56 of the resilient member 42 and the second guiding feature 58 of the second end 24*b* of the handle 24 abut against each other for guiding the first retaining portion 52 of the resilient member 42 and the second retaining portion 54 of the handle 24 to engage with each other for retaining the handle 24 in the locking state K1 relative to the frame 22. When the handle 24 is in the locking state K1, the resilient arm portion 46 is resiliently pressed by the holding portion 24*c* of the handle 24 to accumulate a resilient force f, and the positioning feature 28 passes through the penetrating structure S on the longitudinal wall 32 of the frame 22 to face toward the mounting direction T.

It should be noticed that, as shown in FIG. 6, when it is desired to release the handle 24 from the locking state K1, the operating section 57 or the extending section 55 of the operating portion 48 can be operated by the user to drive the first retaining portion 52 and the second retaining portion 54 to disengage from each other. When the first retaining portion 52 and the second retaining portion 54 disengage from each other to release the handle 24 from the locking state K1, the handle 24 can disengage from the locking state K1, e.g., move or pivot from the locking state K1 to the unlocking state K2 as shown in FIG. 4 along a second predetermined direction R2 as shown in FIG. 5, which is opposite to the first predetermined direction R1, in response to the resilient force f generated by the resilient arm portion 46.

Figure 7:
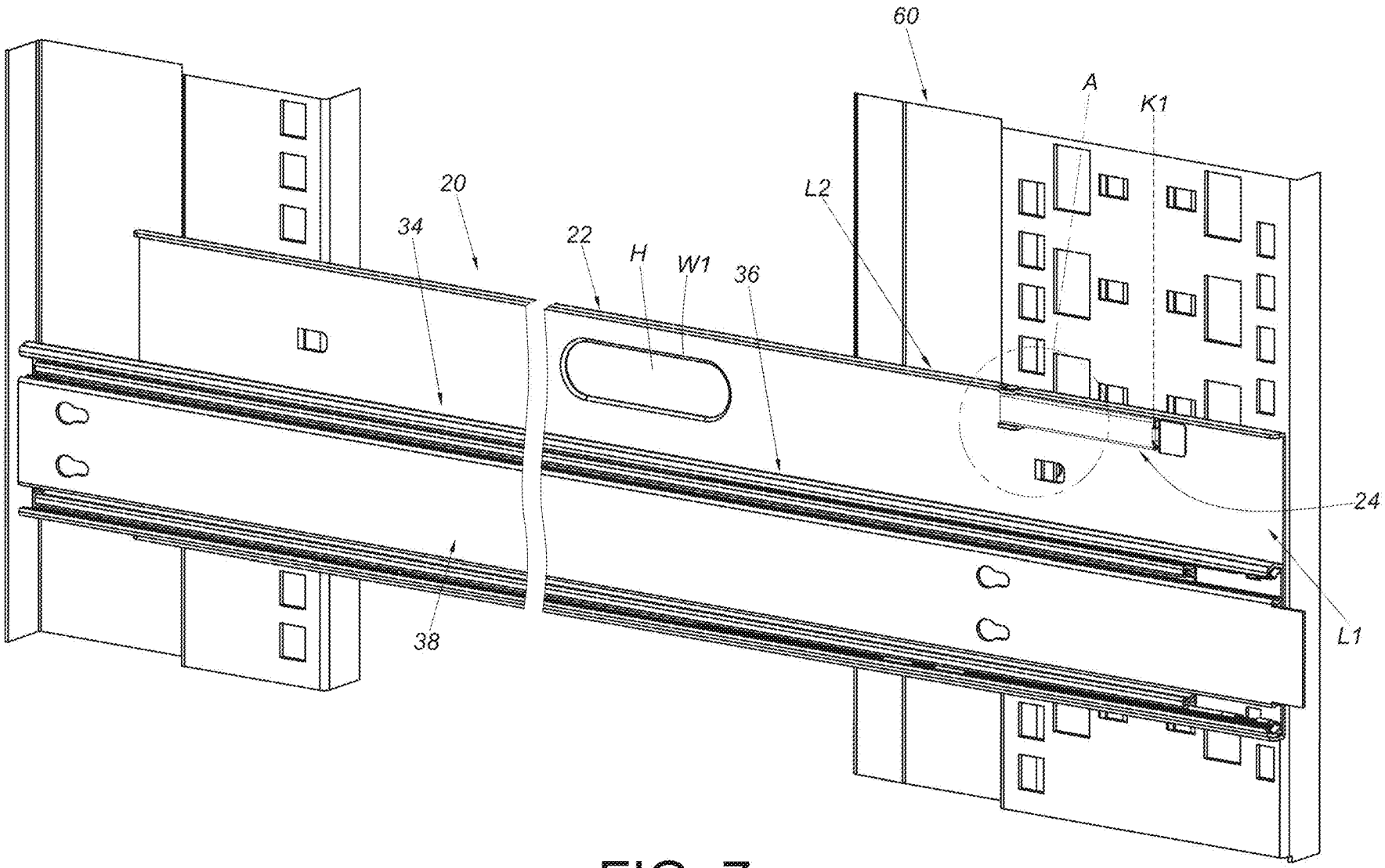
FIG. 7 is a diagram of the rack mounting kit mounted on a rack and restrained from being detached from the rack by the handle in the locking state according to the first embodiment of the present invention.
Figure 8:
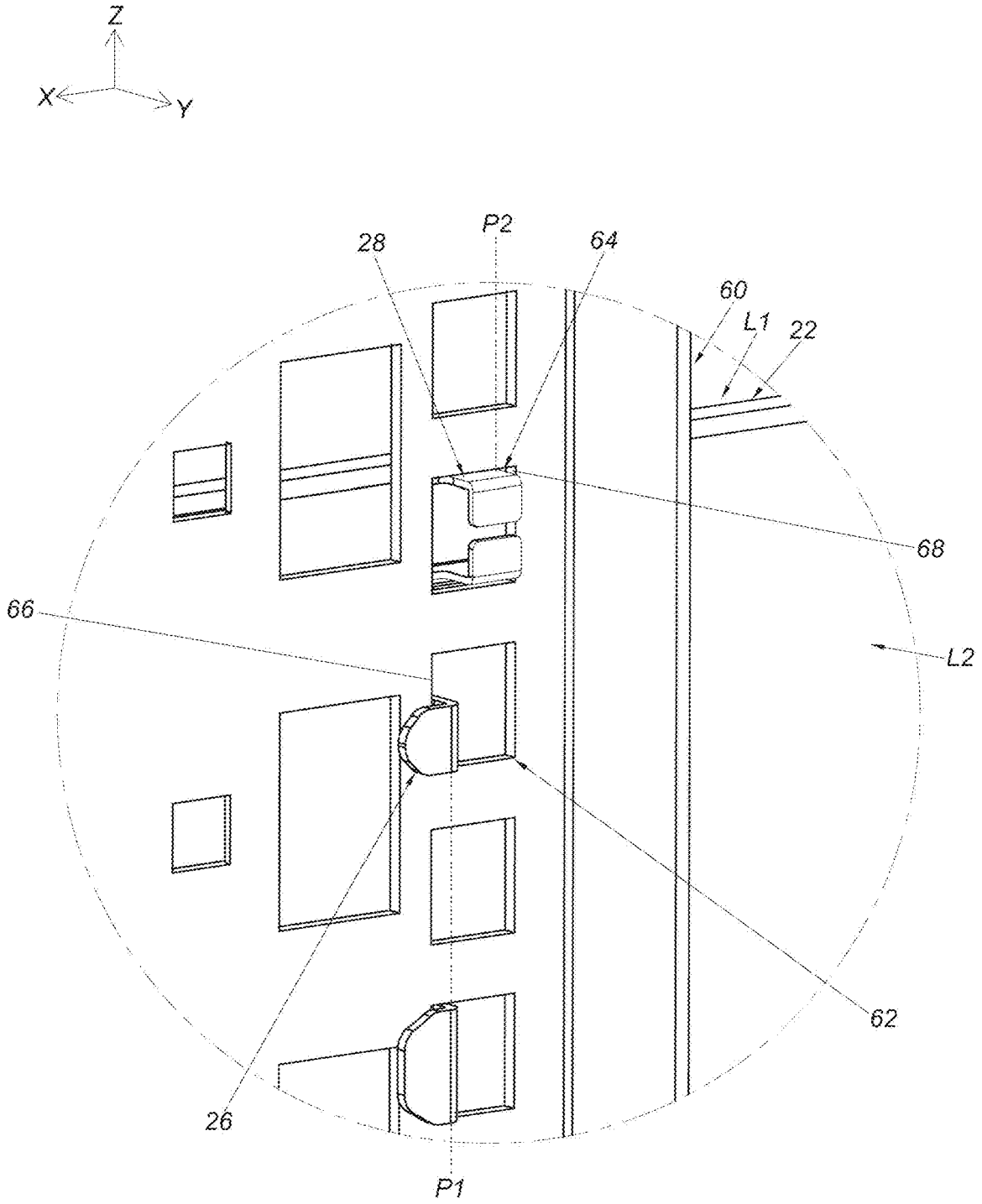
FIG. 8 is an enlarged diagram of an A portion of the rack mounting kit as shown in FIG. 7 according to the first embodiment of the present invention.

As shown in FIG. 7 and FIG. 8, the rack mounting kit 20 is adapted for a rack 60, and the second rail 38 of the slide rail assembly 34 is configured to support a carried object, e.g., an electronic apparatus or a drawer. Furthermore, the rack 60 includes a plurality of mounting portions, e.g., a first mounting portion 62 and a second mounting portion 64. In this embodiment, the mounting portions are mounting holes arranged along the vertical direction.

As shown in FIG. 8, when the handle 24 is in the locking state K1 relative to the frame 22, the mounting feature 26 and the positioning feature 28 are located at a first mounting position P1 and a second mounting position P2 relative to the rack 60, respectively, so as to cooperatively restrain detachment of the frame 22 from the rack 60. Furthermore, when the handle 24 is in the locking state K1 relative to the frame 22, the mounting feature 26 passes through the first mounting portion 62 to engage with a first hole wall 66, e.g., a front hole wall, of the first mounting portion 62, e.g., in a hooking manner, and the positioning feature 28 passes through the second mounting portion 64 to abut against a second hole wall 68, e.g., a rear hole wall, of the second mounting portion 64, so as to prevent the frame 22 from moving relative to the rack 60 for restraining detachment of the frame 22 from the rack 60.

Figure 9:
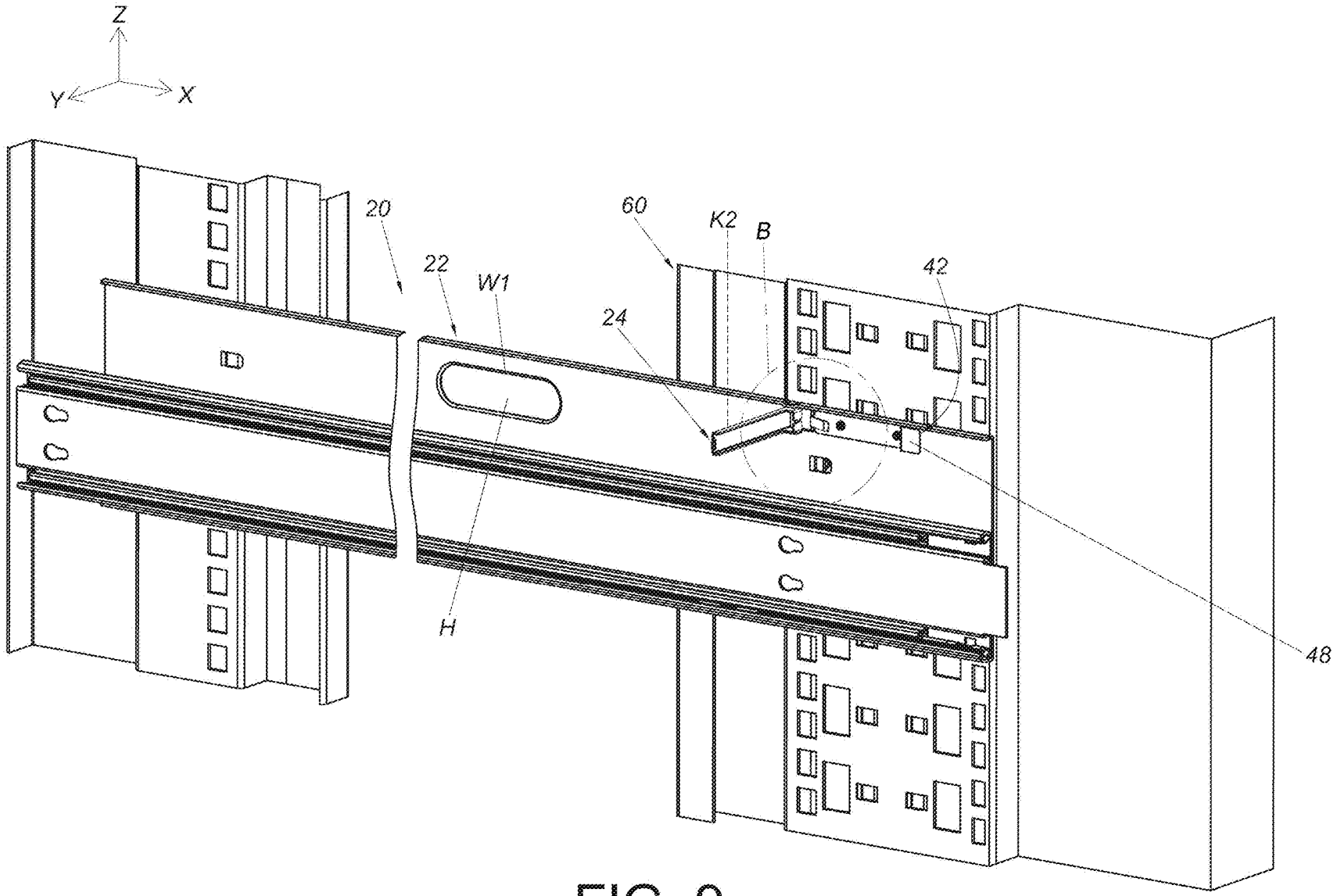
FIG. 9 is a diagram of the rack mounting kit mounted on the rack and allowed to be detached from the rack by the handle in the unlocking state according to the first embodiment of the present invention.
Figure 10:
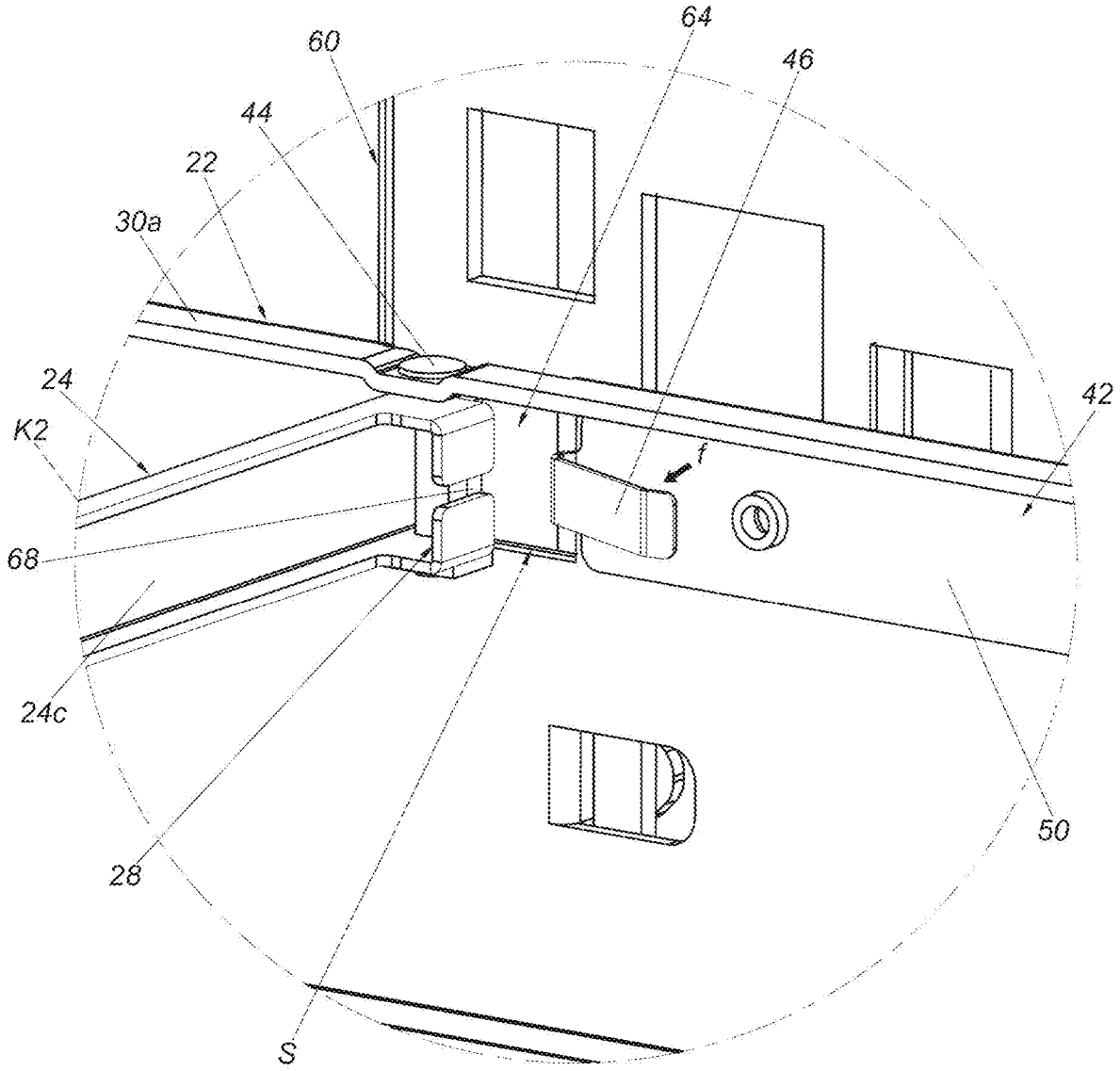
FIG. 10 is an enlarged diagram of a B portion of the rack mounting kit as shown in FIG. 9 according to the first embodiment of the present invention.

As shown in FIG. 9 and FIG. 10, when the handle 24 is released from the locking state K1, the handle 24 can move to the unlocking state K2 to drive the positioning feature 28 of the handle 24 to depart from the second mounting position P2, so as to allow detachment of the frame 22 from the rack 60.

Preferably, when the handle 24 is released from the locking state K1, the handle 24 can move to the unlocking state K2 in response to the resilient force f generated by the resilient arm portion 46.

It should be noticed that, as shown in FIG. 9, when the handle 24 is in the unlocking state K2, the user can hold the handle 24 with one hand, e.g., the right hand, and further hold the through hole structure H with the other hand, e.g., the left hand, stretching into the through hole structure H and against the first wall W1, for supporting the rack mounting kit 20 properly.

From the above, the configuration of the handle 24 and the through hole structure H can enable the user to support the rack mounting kit 20 with the two hands properly, and therefore the rack mounting kit 20 can be moved or lifted easily, such that the rack mounting kit 20 has enhanced convenience and/or safety of mounting operation or detachment operation.

Figure 11:
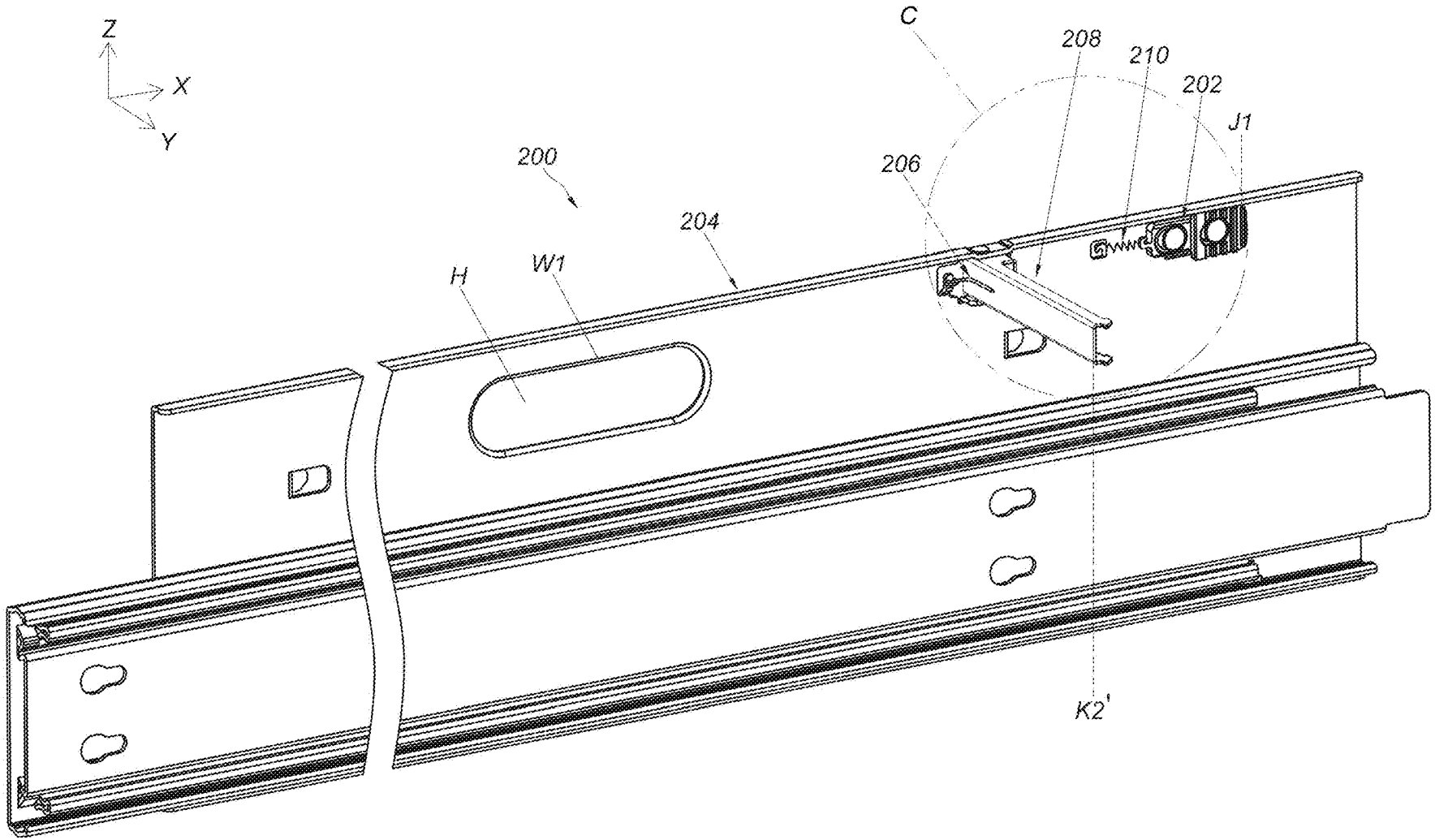
FIG. 11 is a schematic diagram of a rack mounting kit according to a second embodiment of the present invention.
Figure 12:
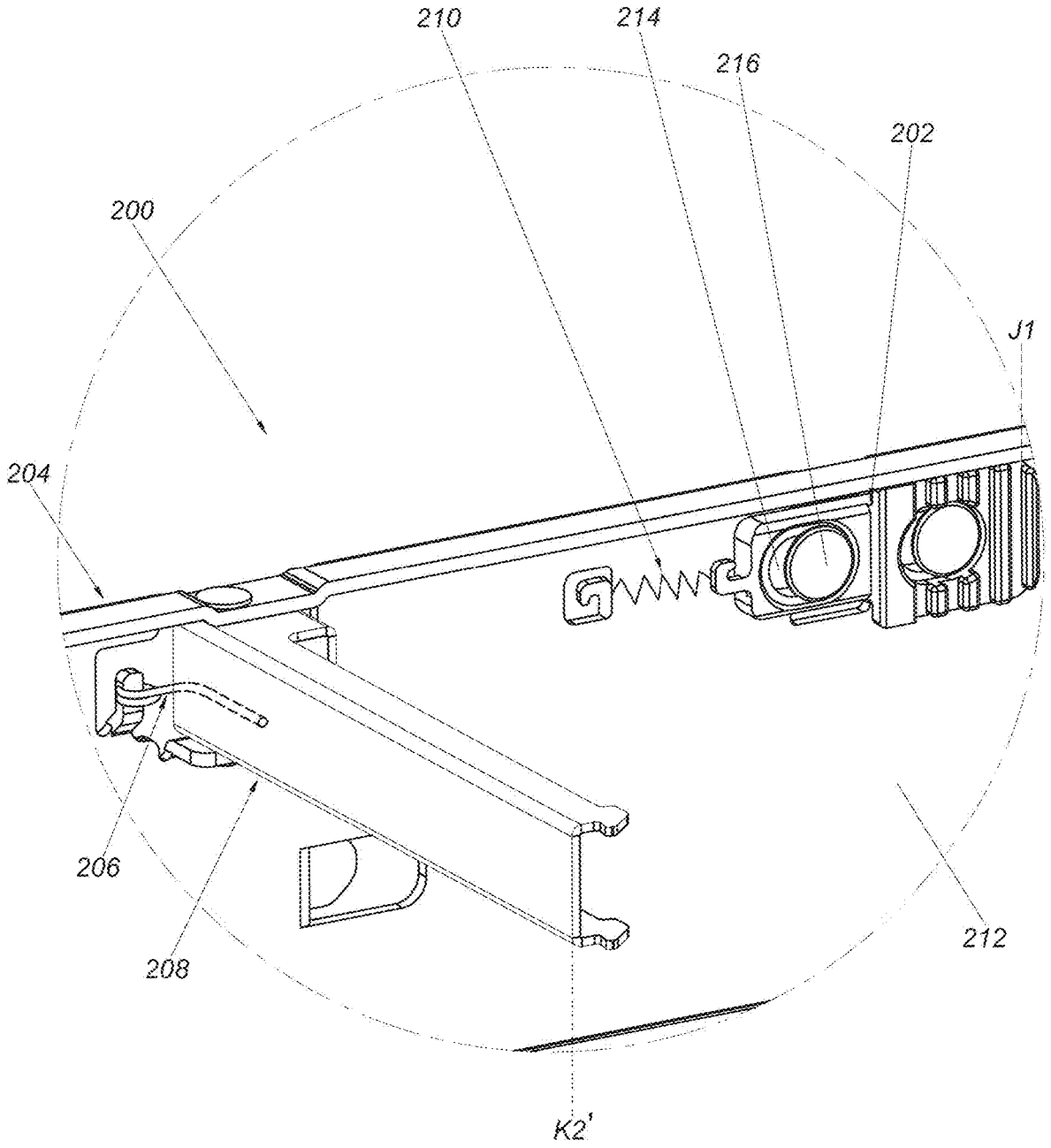
FIG. 12 is an enlarged diagram of a C portion of the rack mounting kit as shown in FIG. 11 according to the second embodiment of the present invention.

As shown in FIG. 11 and FIG. 12, different from the first embodiment, a rack mounting kit 200 of a second embodiment does not include the resilient member 42 of the first embodiment and further includes an auxiliary member 202 and a first elastic member 206. The auxiliary member 202 is movably mounted on a frame 204, and the first elastic member 206 is configured to generate a first elastic force for driving a handle 208. Furthermore, a handle 208 can move to an unlocking state K2' relative to the frame 204 in response to the first elastic force generated by the first elastic member 206, and the auxiliary member 202 can move between a first predetermined position J1 and a second predetermined position J2 relative to the frame 204.

Preferably, the rack mounting kit 200 further includes a second elastic member 210, such that the auxiliary member 202 can be resiliently retained at the first predetermined position J1 relative to the frame 204 in response to a second elastic force generated by the second elastic member 210.

Preferably, a first restraining feature 214 and a second restraining feature 216 are arranged on a longitudinal wall 212 of the frame 204 and the auxiliary member 202, respectively. In this embodiment, by way of example, the first restraining feature 214 and the second restraining feature 216 are an elongated hole and a pin passing through a portion of the elongated hole, respectively, such that the auxiliary member 202 is restricted to move linearly within a predetermined range, e.g., along the longitudinal direction.

Preferably, the handle 208 is configured to move to the unlocking state K2' in response to the first elastic force generated by the first elastic member 206.

Figure 13:
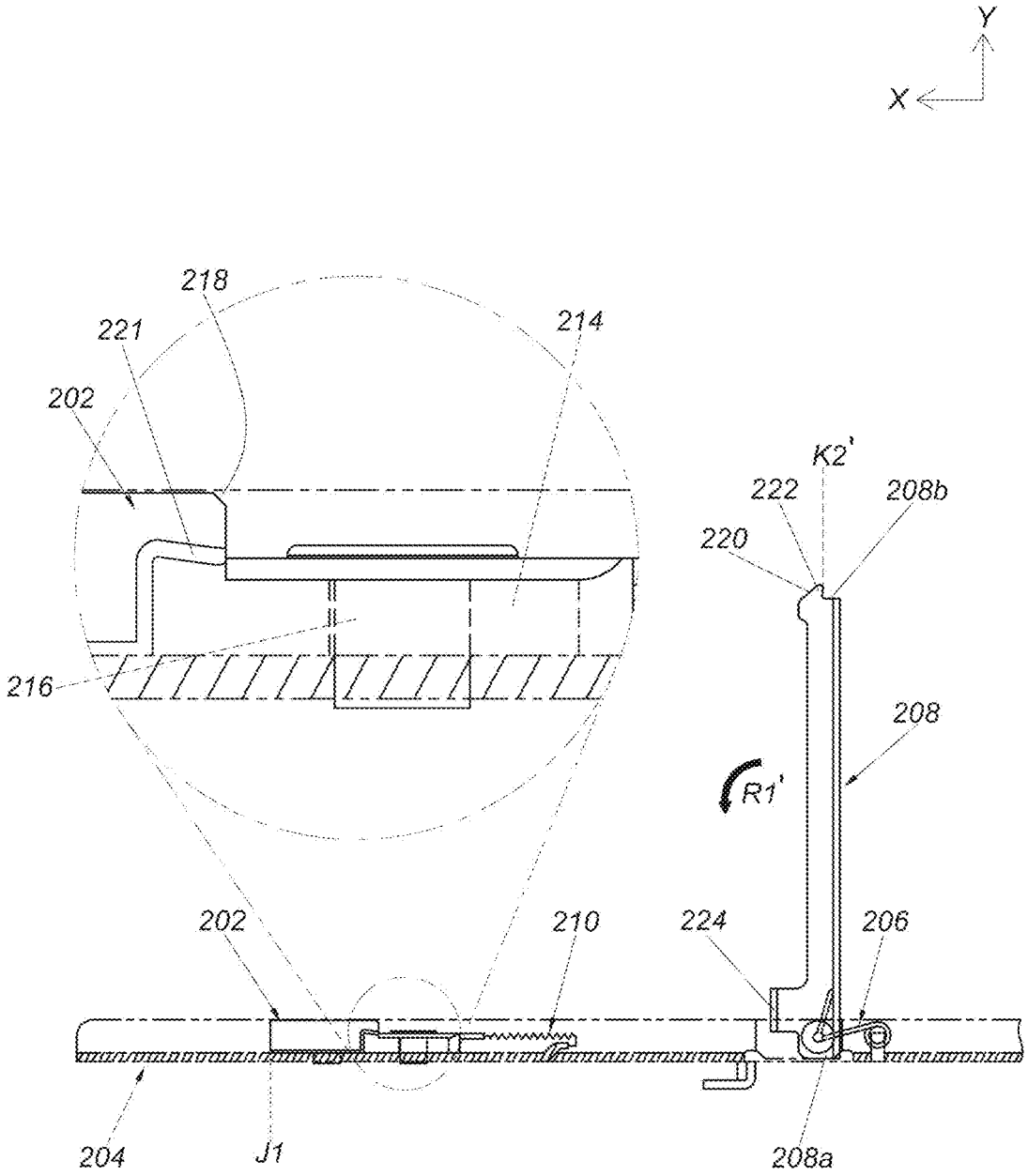
FIG. 13 is a partial diagram of the rack mounting kit as a handle is in an unlocking state according to the second embodiment of the present invention.
Figure 14:
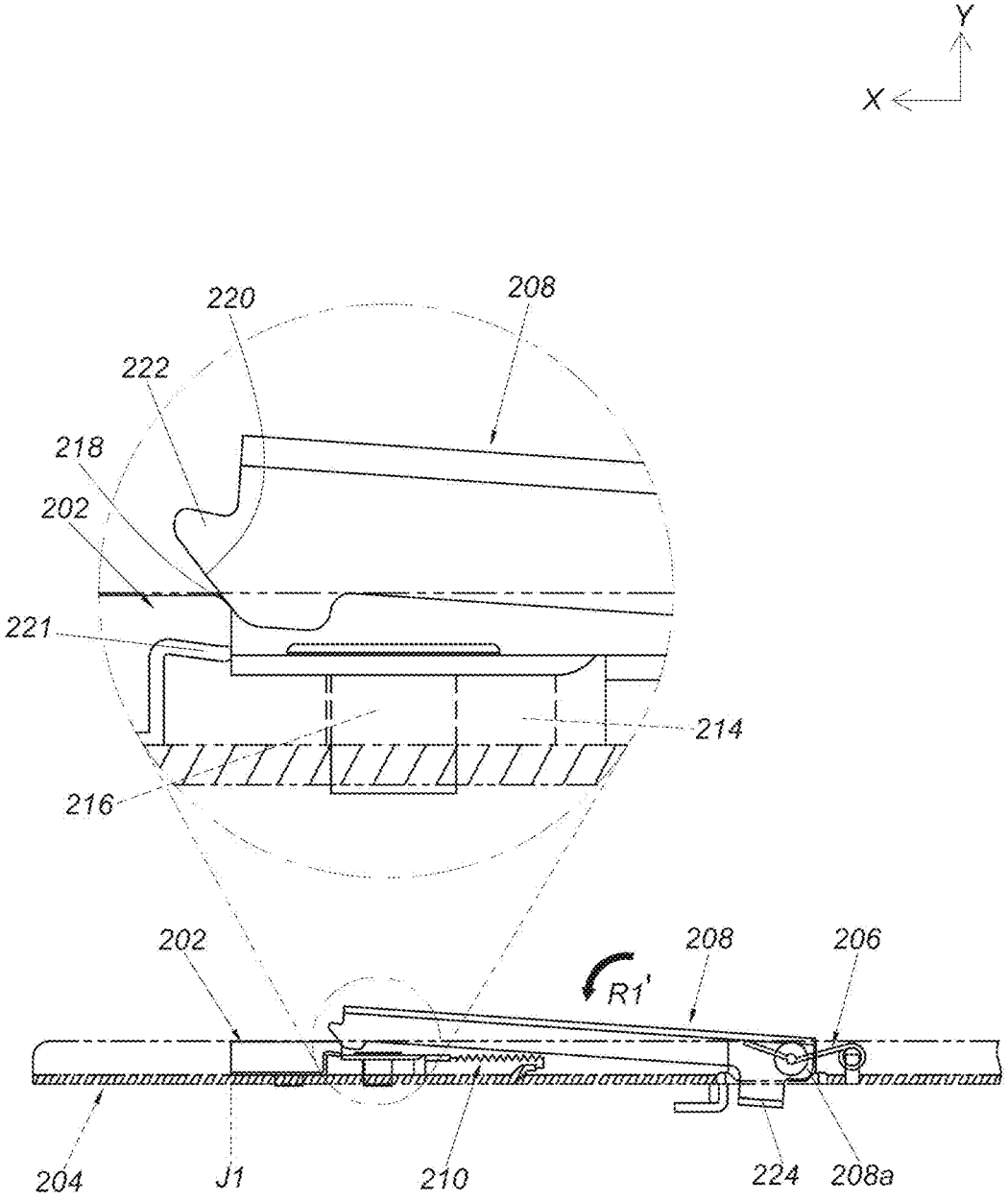
FIG. 14 is a partial diagram of the rack mounting kit as the handle moves toward a locking state from the unlocking state according to the second embodiment of the present invention.
Figure 15:
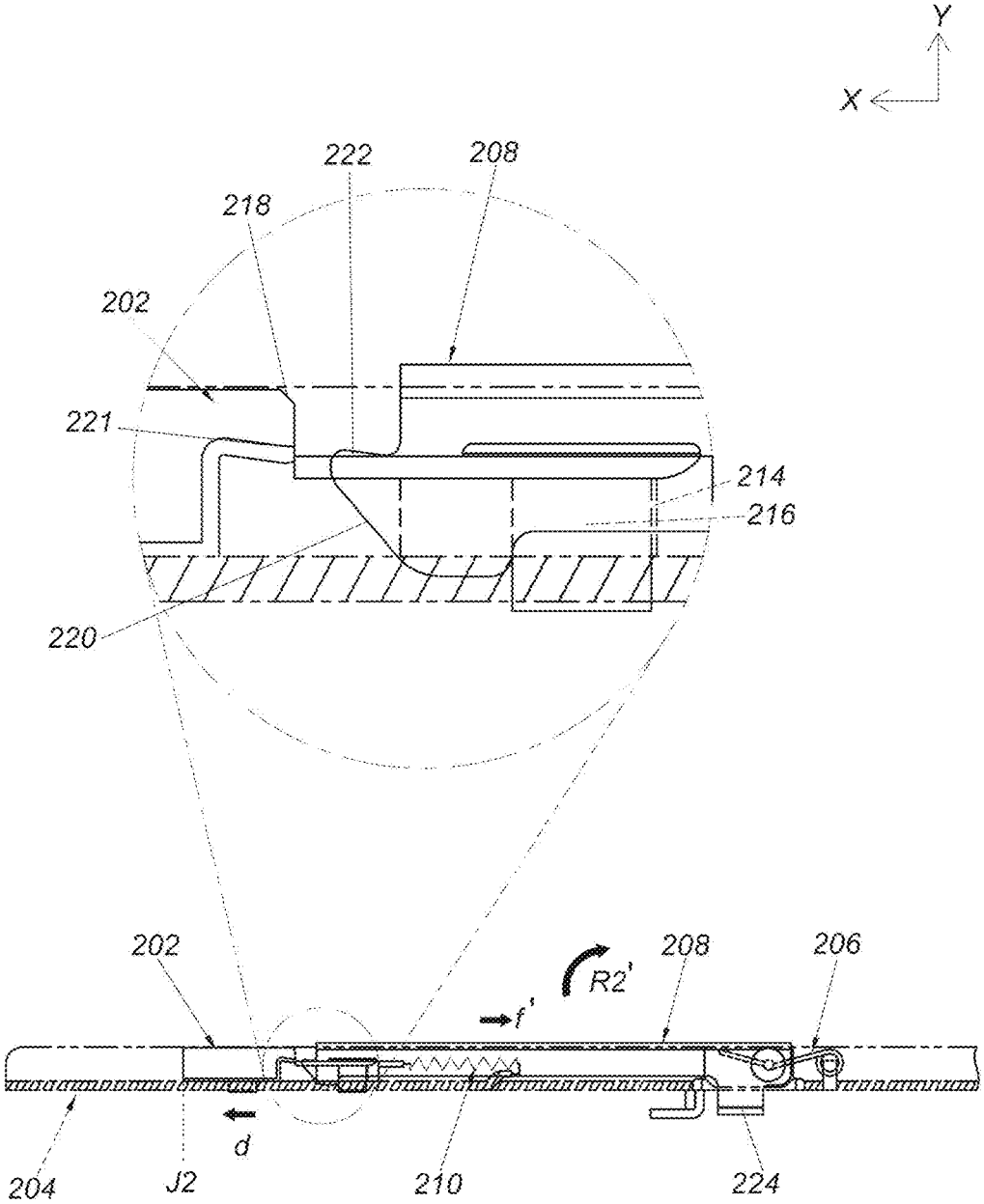
FIG. 15 is a partial diagram of the rack mounting kit as the handle moves toward the locking state from a state as shown in FIG. 14 according to the second embodiment of the present invention.
Figure 16:
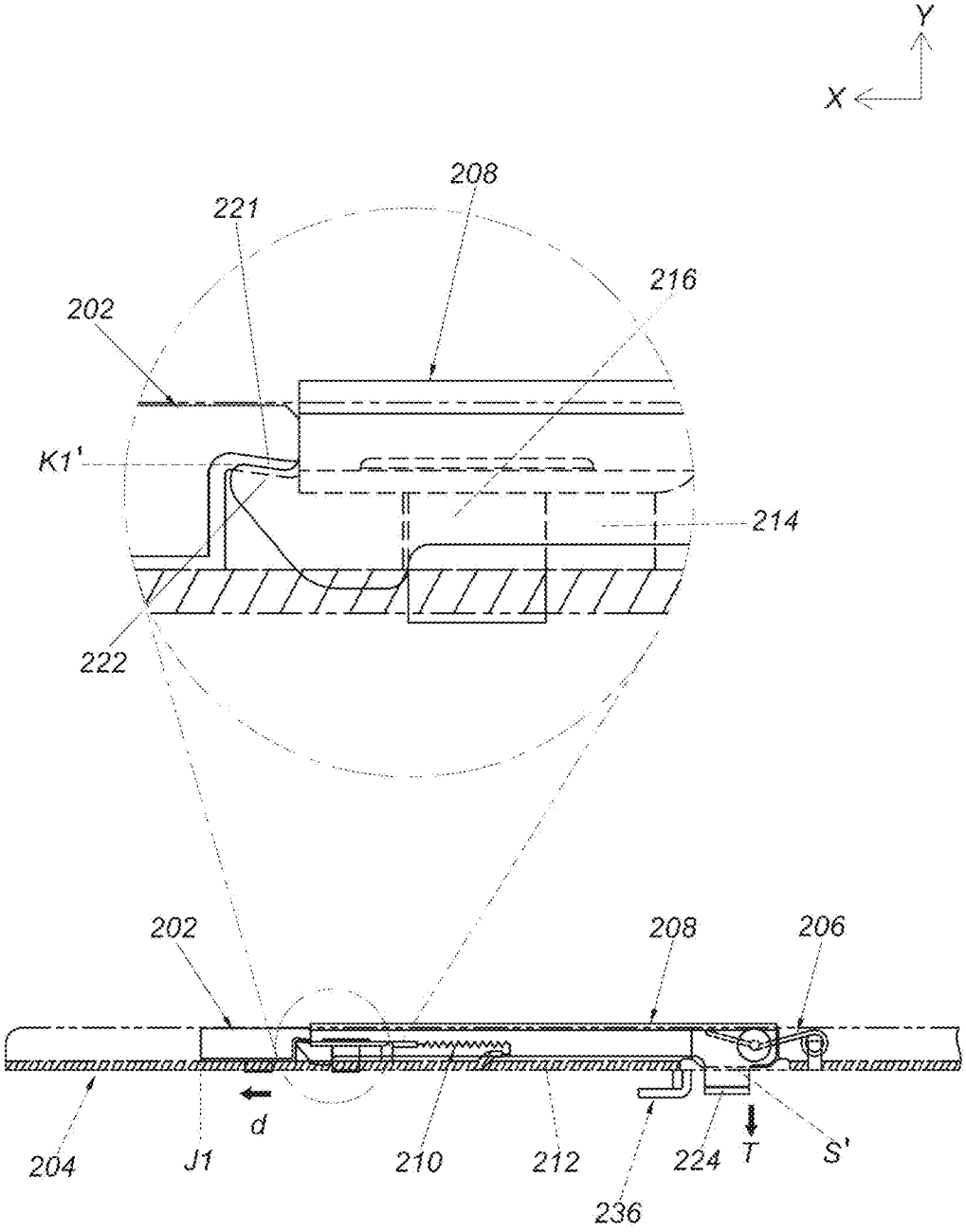
FIG. 16 is a partial diagram of the rack mounting kit as the handle is in the locking state according to the second embodiment of the present invention.

As shown in FIG. 13 to FIG. 16, the handle 208 is movable relative to the frame 204 from the unlocking state K2' as shown in FIG. 13 to the locking state K1' as shown in FIG. 16, or from the locking state K1' as shown in FIG. 16 to the unlocking state K2' as shown in FIG. 13.

Preferably, one of the auxiliary member 202 and a second end 208*b* of the handle 208 includes a guiding feature, e.g., an inclined surface or an arc surface. In this embodiment, by way of example, the auxiliary member 202 and the second end 208*b* of the handle 208 include a first guiding feature 218 and a second guiding feature 220 configured to cooperate with the first guiding feature 218, and the first elastic member 206 is arranged on a first end 208*a* of the handle 208. The first elastic member 206 includes a first elastic section abutting against the frame 204, and a second elastic section abutting against the handle 208. However, the present invention is not limited to this embodiment.

The auxiliary member 202 is configured to be retained at the first predetermined position J1 as shown in FIG. 13 in response to the second elastic force generated by the second elastic member 210. The auxiliary member 202 and the second end 208*b* of the handle 208 include a first retaining portion 221 and a second retaining portion 222, respectively.

As shown in FIG. 13 to FIG. 15, when the handle 208 is operated to move relative to the frame 204 from the unlocking state K2' toward the locking state K1', e.g., pivot along a first predetermined direction R1', the first guiding feature 218 of the auxiliary member 202 and the second guiding feature 220 of the second end 208*b* of the handle 208 abut against each other for driving the auxiliary member 202 to move from the first predetermined position J1 to the second predetermined position J2 along a moving direction d. When the auxiliary member 202 moves from the first predetermined position J1 to the second predetermined position J2 along the moving direction d, the second elastic member 210 is resiliently deformed to accumulate a second elastic force f' along a direction opposite to the moving direction d. Afterwards, when the second guiding feature 220 of the second end 208*b* of the handle 208 passes over the first guiding feature 218 of the auxiliary member 202, the second elastic member 210 can be released, such that the auxiliary member 202 can move from the second predetermined position J2 to the first predetermined position J1 in response to the second elastic force f', so as to drive the first retaining portion 221 of the auxiliary member 202 and the second retaining portion 222 of the handle 208 to engage with each other for retaining the handle 208 in the locking state K1' relative to the frame 204 as shown in FIG. 16. Furthermore, as shown in FIG. 16, when the handle 208 is in the locking state K1', the first elastic member 206 is resiliently deformed to accumulate the first elastic force, and a positioning feature 224 of the handle 208 passes through a penetrating structure S' on the longitudinal wall 212 of the frame 204 to face toward the mounting direction T.

It should be noticed that, as shown in FIG. 16, when it is desired to release the handle 208 from the locking state K1', the auxiliary member 202 can be operated by the user to move from the first predetermined position J1 to the second predetermined position J2 along the moving direction d by overcoming the second elastic force generated by the second elastic member 210, for driving the first retaining portion 221 and the second retaining portion 222 to disengage from each other. When the first retaining portion 221 and the second retaining portion 222 disengage from each other to release the handle 208 from the locking state K1', the handle 208 can disengage from the locking state K1', e.g., move or pivot from the locking state K1' to the unlocking state K2' as shown in FIG. 13 along a second predetermined direction R2' as shown in FIG. 15, which is opposite to the first predetermined direction R1', in response to the first elastic force generated by the first elastic member 206.

Figure 17:
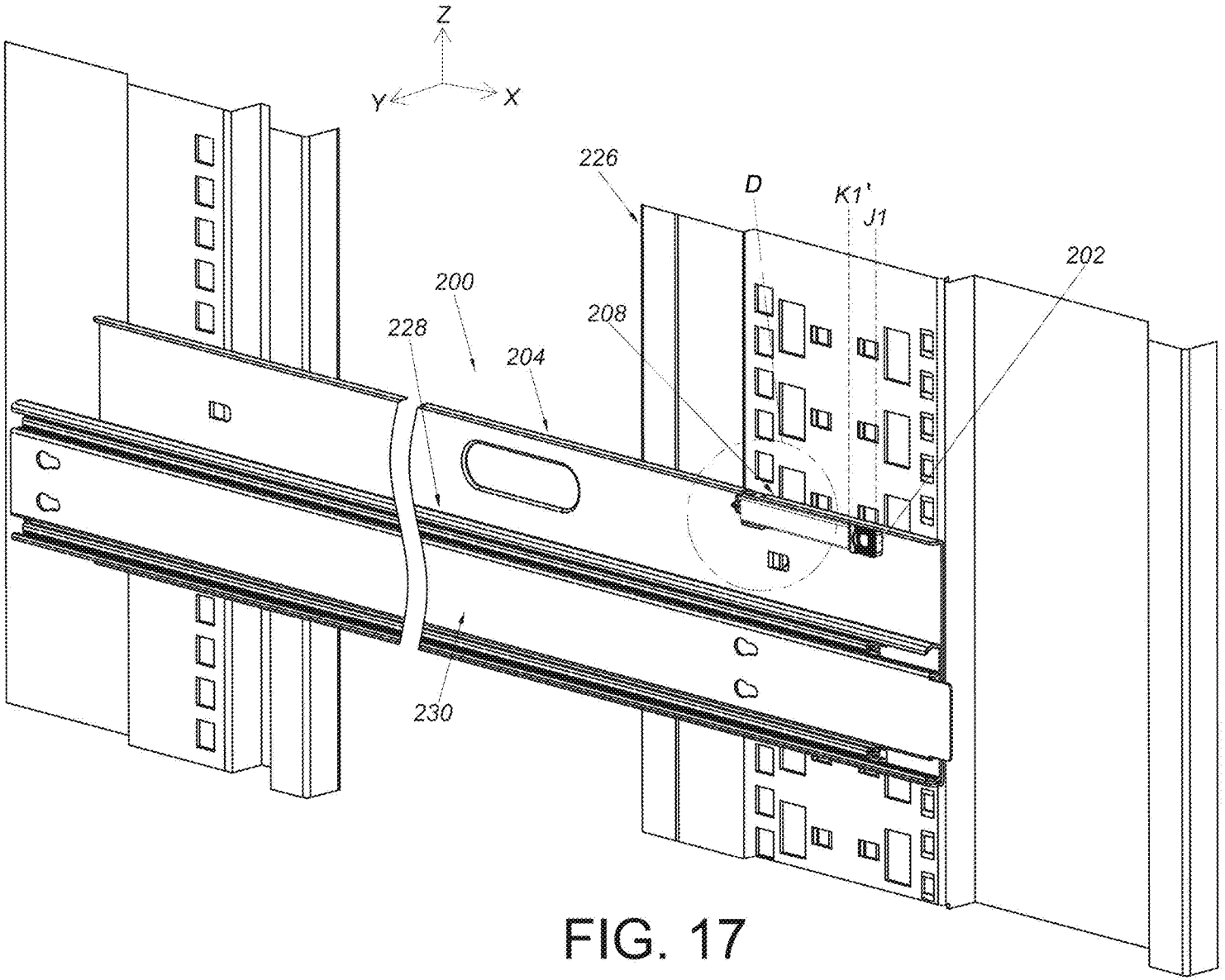
FIG. 17 is a diagram of the rack mounting kit mounted on a rack and restrained from being detached from the rack by the handle in the locking state according to the second embodiment of the present invention.
Figure 18:
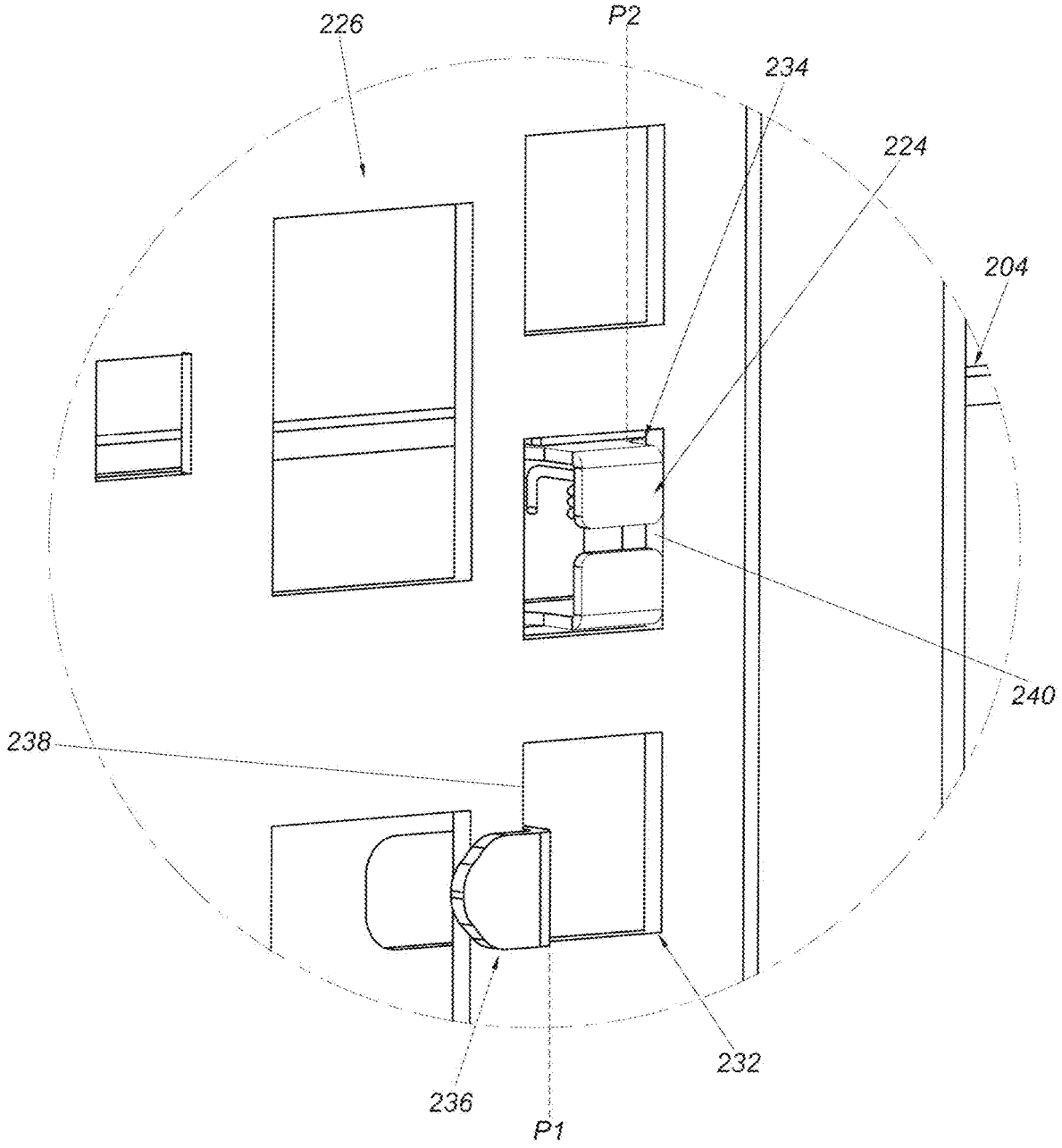
FIG. 18 is an enlarged diagram of a D portion of the rack mounting kit as shown in FIG. 17 according to the second embodiment of the present invention.

As shown in FIG. 17 and FIG. 18, the rack mounting kit 200 is adapted for a rack 226, and a second rail 230 of a slide rail assembly 228 is configured to support a carried object, e.g., an electronic apparatus or a drawer. Furthermore, the rack 226 includes a plurality of mounting portions, e.g., a first mounting portion 232 and a second mounting portion 234. In this embodiment, the mounting portions are mounting holes arranged along the vertical direction.

As shown in FIG. 18, when the handle 208 is in the locking state K1' relative to the frame 204, a mounting feature 236 and the positioning feature 224 are located at a first mounting position P1' and a second mounting position P2' relative to the rack 226, respectively, so as to cooperatively restrain detachment of the frame 204 from the rack 226. Furthermore, when the handle 208 is in the locking state K1' relative to the frame 204, the mounting feature 236 passes through the first mounting portion 232 to engage with a first hole wall 238, e.g., a front hole wall, of the first mounting portion 232, e.g., in a hooking manner, and the positioning feature 224 passes through the second mounting portion 234 to abut against a second hole wall 240, e.g., a rear hole wall, of the second mounting portion 234, so as to prevent the frame 204 from moving relative to the rack 226 for restraining detachment of the frame 204 from the rack 226.

It should be noticed that, when the handle 208 disengages from the locking state K1', e.g., move from the locking state K1' to the unlocking state K2', the positioning feature 224 of the handle 208 can depart from the second mounting position P2' to allow detachment of the frame 204 from the rack 226 in response to movement of the handle 208 from the locking state K1' to the unlocking state K2'.

Other details of this embodiment are the same as the ones of the first embodiment. Detailed description is omitted herein for simplicity.

From the above, the rack mounting kits 20, 200 of the present invention include the following characteristics of that when the handles 24, 208 are in the unlocking states K2, K2', the rack mounting kits 20, 200 can be held or lifted easily by the user with the two hands respectively holding the handles 24, 208 and the longitudinal walls 32, 212 of the frames 22, 204, such that the rack mounting kits 20, 200 have enhanced convenience and/or safety of mounting operation or detachment operation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A rack mounting kit comprising:

a frame comprising a mounting feature;

a resilient member arranged on the frame, the resilient member comprising a first retaining portion; and a handle movably mounted on the frame, and the handle comprising a first end pivotally mounted on the frame, a second end, a holding portion located between the first end and the second end, and a positioning feature, the second end of the handle comprising a second retaining portion;

wherein when the handle is in a locking state, both of the positioning feature of the handle and the mounting feature of the frame face toward a mounting direction;

wherein when the handle moves from the locking state to an unlocking state, the positioning feature of the handle faces toward an operating direction different from the mounting direction for allowing the handle to be held by a user;

wherein the mounting feature of the frame and the positioning feature of the handle are configured to pass through a first mounting portion and a second mounting portion of a rack when the handle is in the locking state;

wherein the first retaining portion and the second retaining portion engages with each other, such that the handle is retained in the locking state relative to the frame.

2. The rack mounting kit of claim 1, wherein the resilient member further comprises an operating portion located adjacent to the first retaining portion, and the operating portion is configured to be operated to drive the first retaining portion and the second retaining portion to disengage from each other, such that the handle is released from the locking state.

3. The rack mounting kit of claim 2, wherein the resilient member further comprises a resilient arm portion configured to generate a resilient force for driving the handle to disengage from the locking state when the handle is released from the locking state.

4. The rack mounting kit of claim 3, wherein the frame comprises a through hole structure defined by a plurality of walls, and the through hole structure and the handle are configured to be held by two hands of the user.

5. The rack mounting kit of claim 1, wherein one of the resilient member and the second end of the handle comprises a guiding feature, and when the handle moves from the unlocking state to the locking state, the second end of the handle and the resilient member abut against each other by the guiding feature, so as to guide the second retaining portion of the handle to engage with the first retaining portion of the resilient member for retaining the handle in the locking state.

6. The rack mounting kit of claim 1, wherein the positioning feature of the handle is located adjacent to the first end of the handle.

7. A rack mounting kit adapted for a rack, the rack mounting kit comprising:

a frame comprising a mounting feature configured to be mounted at a first mounting position relative to the rack;

a handle movably mounted on the frame and comprising:

a positioning feature configured to be mounted at a second mounting position relative to the rack;

a first end pivotally mounted on the frame;

a second end; and a holding portion located between the first end and the second end; and a resilient member arranged on the frame;

wherein when the handle is in a locking state relative to the frame, the mounting feature located at the first mounting position and the positioning feature located at the second mounting position cooperatively restrain the frame from being detached from the rack;

wherein when the handle is released from the locking state relative to the frame, the positioning feature is configured to depart from the second mounting position for allowing the frame to be detached from the rack;

wherein the resilient member comprises a first retaining portion, the second end of the handle comprises a second retaining portion, and the first retaining portion and the second retaining portion engage with each other, such that the handle is retained in the locking state relative to the frame.

8. The rack mounting kit of claim 7, wherein the resilient member further comprises an operating portion located adjacent to the first retaining portion, and the operating portion is configured to be operated to drive the first retaining portion and the second retaining portion to disengage from each other, such that the handle is released from the locking state.

9. The rack mounting kit of claim 8, wherein the resilient member further comprises a resilient arm portion configured to generate a resilient force for driving the handle to disengage from the locking state when the handle is released from the locking state.

10. The rack mounting kit of claim 9, wherein the frame comprises a through hole structure defined by a plurality of walls, and the through hole structure and the handle are configured to be held by two hands of a user.

11. The rack mounting kit of claim 7, wherein one of the resilient member and the second end of the handle comprises a guiding feature, and when the handle moves from an unlocking state to the locking state, the second end of the handle and the resilient member abut against each other by the guiding feature, so as to guide the second retaining portion of the handle to engage with the first retaining portion of the resilient member for retaining the handle in the locking state.

12. The rack mounting kit of claim 7, wherein the positioning feature of the handle is located adjacent to the first end of the handle.

* * * * *